US008491422B2

(12) United States Patent
Deschesnes et al.

(10) Patent No.: US 8,491,422 B2
(45) Date of Patent: Jul. 23, 2013

(54) SWING EXERCISING APPARATUS

(75) Inventors: Dimitrios Deschesnes, Outremont (CA); Alcide Deschesnes, Outremont (CA)

(73) Assignee: Dynamic Inertia Fitness Inc., Outremont, Quebec (CA)

( * ) Notice: Subject to any disclaimer, the term of this patent is extended or adjusted under 35 U.S.C. 154(b) by 277 days.

(21) Appl. No.: 12/811,294

(22) PCT Filed: Dec. 29, 2008

(86) PCT No.: PCT/CA2008/002299

§ 371 (c)(1),
(2), (4) Date: Jun. 30, 2010

(87) PCT Pub. No.: WO2009/082823

PCT Pub. Date: Jul. 9, 2009

(65) Prior Publication Data

US 2010/0285907 A1 Nov. 11, 2010

Related U.S. Application Data

(60) Provisional application No. 61/009,675, filed on Dec. 31, 2007, provisional application No. 61/033,617, filed on Mar. 4, 2008.

(51) Int. Cl.
*A63B 69/00* (2006.01)

(52) U.S. Cl.
USPC ..... 473/437; 473/422

(58) Field of Classification Search
USPC ..... 473/234, 457, 482, 437, 422; 280/477; D21/791; 482/109, 125, 126
See application file for complete search history.

(56) References Cited

U.S. PATENT DOCUMENTS 1,418,401 A * 6/1922 Schmidt ..... 446/402
3,414,260 A * 12/1968 Gust ..... 482/109
3,428,325 A * 2/1969 Atkinson ..... 473/256

(Continued)

OTHER PUBLICATIONS

International Search Report, PCT/CA2008/002299, dated Apr. 15, 2009, 4 pages.

(Continued)

*Primary Examiner* — Gene Kim
*Assistant Examiner* — M Chambers
(74) *Attorney, Agent, or Firm* — Senniger Powers LLP

(57) ABSTRACT

A swing exercising apparatus which can be used for improving a swing movement performed when practicing a sport or for other exercising purposes. The swing exercising apparatus comprises: a handle portion for grasping by the user; an elongated member having a distal end; a movable weight component for moving along the elongated member between a first position and a second position when the user swings the swing exercising apparatus, the movable weight component being closer to the distal end in the second position than in the first position; and a biasing mechanism comprising at least one elastic element for exerting a force biasing the movable weight component towards the first position when the movable weight component is located away from the first position along the elongated member. The biasing mechanism may comprise an attachment portion to attach the at least one elastic element, the attachment portion allowing the user to detach any of the at least one elastic element to adjust the force. The swing exercising apparatus may comprise a return mechanism comprising at least one elastic element for exerting a second force contributing to return the movable weight component towards the first position when the movable weight component compresses the at least one elastic element of the return mechanism.

56 Claims, 13 Drawing Sheets

U.S. PATENT DOCUMENTS

| | | | | |
|---|---|---|---|---|
| 3,545,121 | A * | 12/1970 | Misko | 446/486 |
| 4,809,975 | A | 3/1989 | Lee | |
| 4,969,921 | A | 11/1990 | Silvera | |
| 5,024,436 | A | 6/1991 | Vento | |
| 5,312,308 | A * | 5/1994 | Hamilton et al. | 482/44 |
| 5,769,734 | A * | 6/1998 | Qualey, Sr. | 473/233 |
| 6,632,197 | B2 * | 10/2003 | Lyon | 604/107 |
| 6,955,610 | B1 | 10/2005 | Czaja et al. | |
| 7,115,042 | B2 | 10/2006 | Gulan et al. | |
| 7,175,575 | B1 * | 2/2007 | Dantolen | 482/128 |
| 7,297,077 | B1 * | 11/2007 | Battaglino | 473/457 |
| 7,611,449 | B2 | 11/2009 | Kim | |
| 7,621,859 | B2 | 11/2009 | Kim | |
| 2007/0123399 | A1 | 5/2007 | Kim | |
| 2007/0275796 | A1 * | 11/2007 | Carter | 473/459 |

OTHER PUBLICATIONS

Written Opinion, PCT/CA2008/002299, dated Apr. 15, 2009, 5 pages.

* cited by examiner

SWING EXERCISING APPARATUS

CROSS-REFERENCE TO RELATED APPLICATIONS

This application claims the benefit under 35 USC 119(*e*) of U.S. Provisional Patent Application No. 61/009,675 filed on Dec. 31, 2007 and of U.S. Provisional Patent Application No. 61/033,617 filed on Mar. 4, 2008, both incorporated by reference herein.

FIELD OF THE INVENTION

The invention relates generally to exercising apparatus and, more particularly, to a swing exercising apparatus which can be used for improving a swing movement performed when practicing a sport or for other exercising purposes.

BACKGROUND

Several sports, including golf, tennis, baseball, cricket and hockey to name a few, require that an individual performs a swing movement.

Certain swing training devices have been designed to help a user of the device improve a swing movement. In general, these prior swing training devices have more or less an elongated shape and rely on centrifugal force to displace a weight along the elongated device. Displacement of the weight during the swing movement creates a force which allows the user to improve speed, power as well as the mechanics and timing of the swing movement.

Existing swing training devices exhibit many deficiencies. For example, existing swing training devices typically have a weight slidably mounted on a shaft, a handle at one end of the shaft, a stop at the other end of the shaft, and a spring mounted to the weight and one of the ends of the shaft so that, when the device is swung by a user, the user can feel resistance in his/her swing movement caused by the movement of the weight along the shaft and the force of the spring acting on the weight. In this type of device, the adjustability of the force is limited and not versatile. Also, in this type of device, the weight stops very abruptly during the swing movement when it encounters the stop at the end of the shaft, thereby imparting a sudden high centripetal force to the user which may not be desirable.

Accordingly, there is a need for improvements in swing exercising apparatus for improving a swing movement performed when practicing a sport or for other exercising purposes.

SUMMARY OF THE INVENTION

In accordance with a broad aspect, the invention provides a swing exercising apparatus comprising: a handle for grasping by a user; an elongated member having a distal end; a movable weight component for moving along the elongated member between a first position and a second position when the user swings the swing exercising apparatus, the movable weight component being closer to the distal end in the second position than in the first position; and a biasing mechanism for exerting a force biasing the movable weight component towards the first position when the movable weight component is located away from the first position along the elongated member, the biasing mechanism comprising: at least one elastic element to generate the force; and an attachment portion to attach the at least one elastic element, the attachment portion allowing the user to detach any of the at least one elastic element to adjust the force.

In accordance with another broad aspect, the invention provides a swing exercising apparatus comprising: a handle for grasping by a user; an elongated member having a distal end; a movable weight component for moving along the elongated member between a first position and a second position when the user swings the swing exercising apparatus, the movable weight component being closer to the distal end in the second position than in the first position; a biasing mechanism comprising at least one elastic element for exerting a first force biasing the movable weight component towards the first position when the movable weight component is located away from the first position along the elongated member; and a return mechanism comprising at least one elastic element for exerting a second force contributing to return the movable weight component towards the first position when the movable weight component compresses the at least one elastic element of the return mechanism.

In accordance with a further broad aspect, the invention provides a swing exercising apparatus comprising: a handle for grasping by a user, the handle having a longitudinal axis; an elongated member having a distal end; a movable weight component for moving along the elongated member between a first position and a second position when the user swings the swing exercising apparatus, the movable weight component being closer to the distal end in the second position than in the first position; a biasing mechanism comprising at least one elastic element for exerting a force biasing the movable weight component towards the first position when the movable weight component is located away from the first position along the elongated member; the elongated member having a configuration such that, when the movable weight component moves along the elongated member towards the second position, the movable weight component follows a path diverging from the longitudinal axis of the handle.

In accordance with yet a further broad aspect, the invention provides a swing exercising apparatus comprising: a handle for grasping by a user; an elongated member having a distal end; a movable weight component for moving along the elongated member between a first position and a second position when the user swings the swing exercising apparatus, the movable weight component being closer to the distal end in the second position than in the first position; a biasing mechanism comprising at least one elastic element for exerting a force biasing the movable weight component towards the first position when the movable weight component is located away from the first position along the elongated member; and an arm attachment for attaching the handle to an arm of the user, the arm attachment comprising an arm engaging portion for engaging the arm of the user in a region remote from a wrist of the user such that, when the arm of the user swings the swing exercising apparatus, the wrist of the user undergoes isometric contraction.

These and other aspects of the invention will now become apparent to those of ordinary skill in the art upon review of the following description of embodiments of the invention in conjunction with the accompanying drawings.

BRIEF DESCRIPTION OF THE DRAWINGS

A detailed description of embodiments of the invention is provided below, by way of example only, with reference to the accompanying drawings, in which.

It is to be expressly understood that the description and drawings are only for the purpose of illustrating certain embodiments of the invention and are an aid for understanding. They are not intended to be a definition of the limits of the invention.

DETAILED DESCRIPTION OF EMBODIMENTS

Figure 1A:
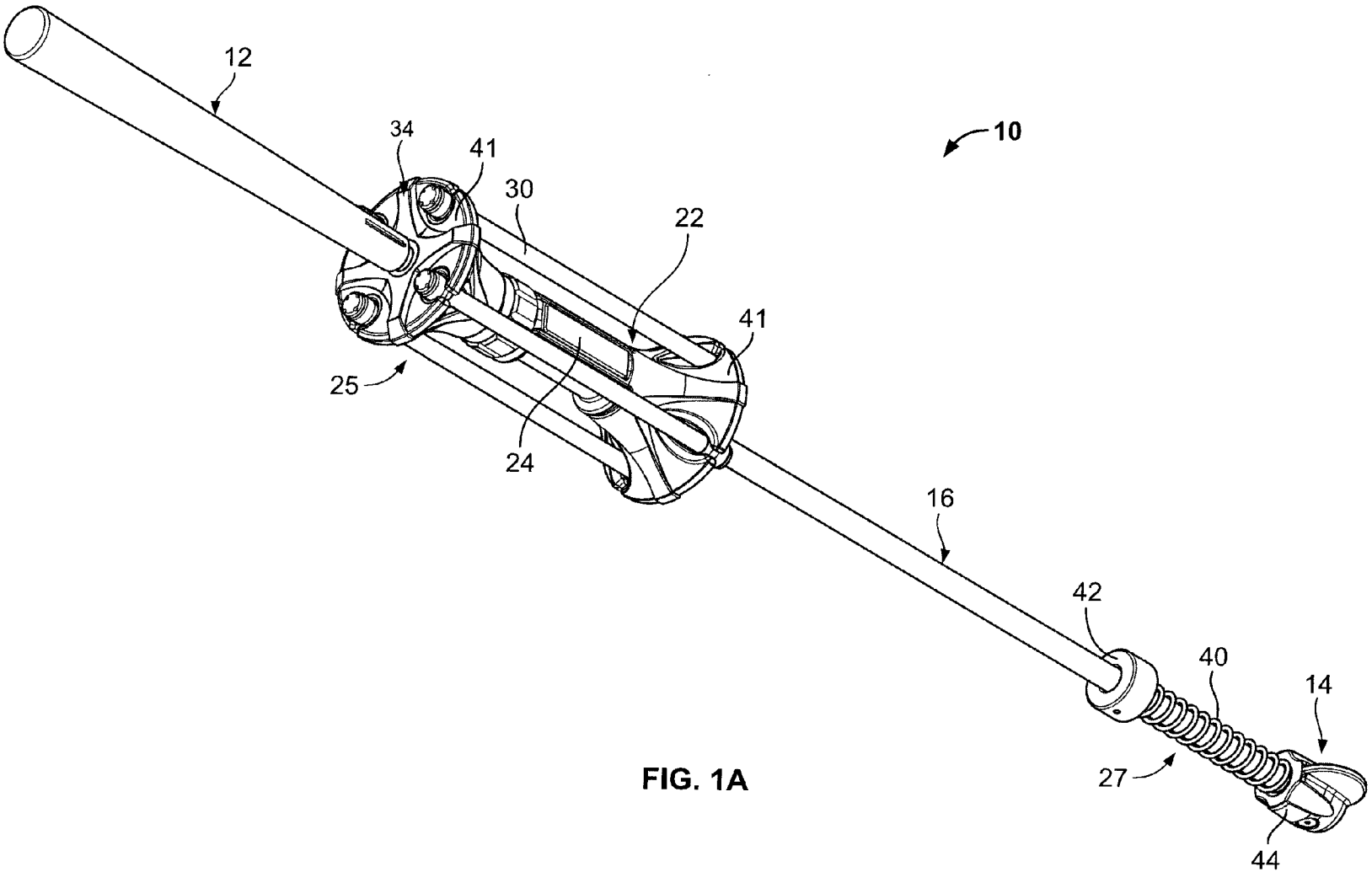
FIGS. 1A to 1C show a swing exercising apparatus in accordance with an embodiment of the invention.
Figure 1B:
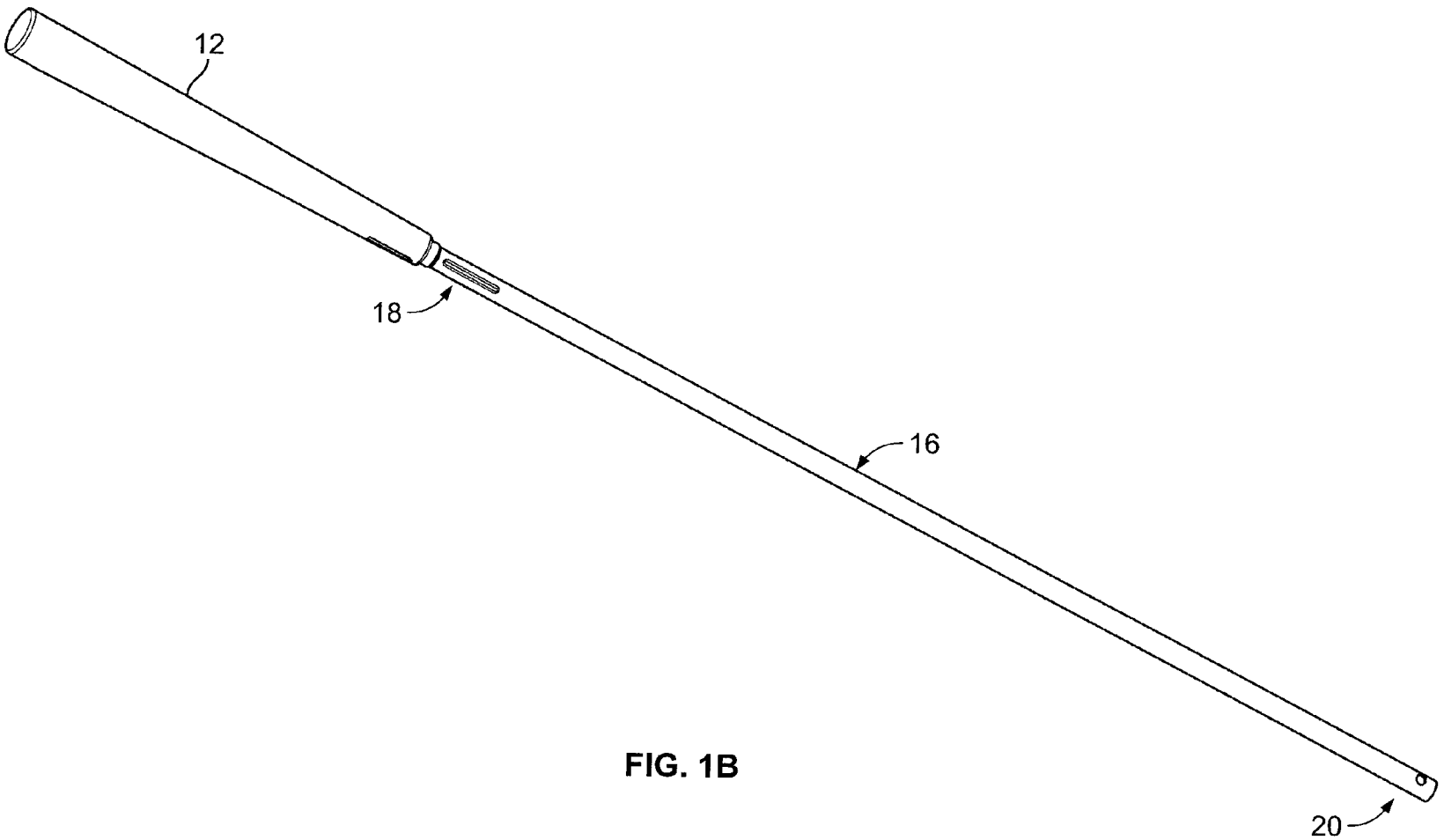
Figure 1C:
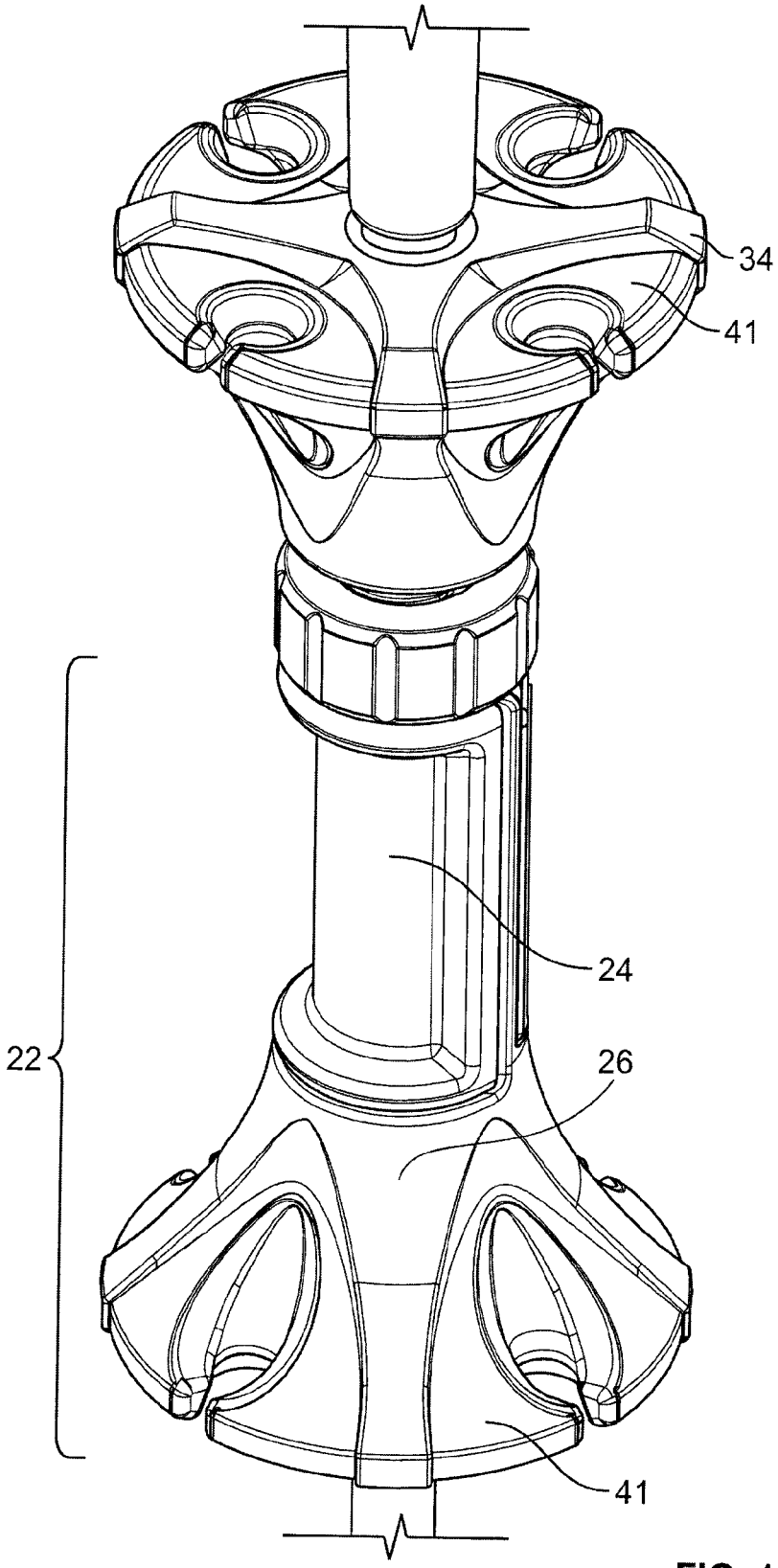
Figure 2:
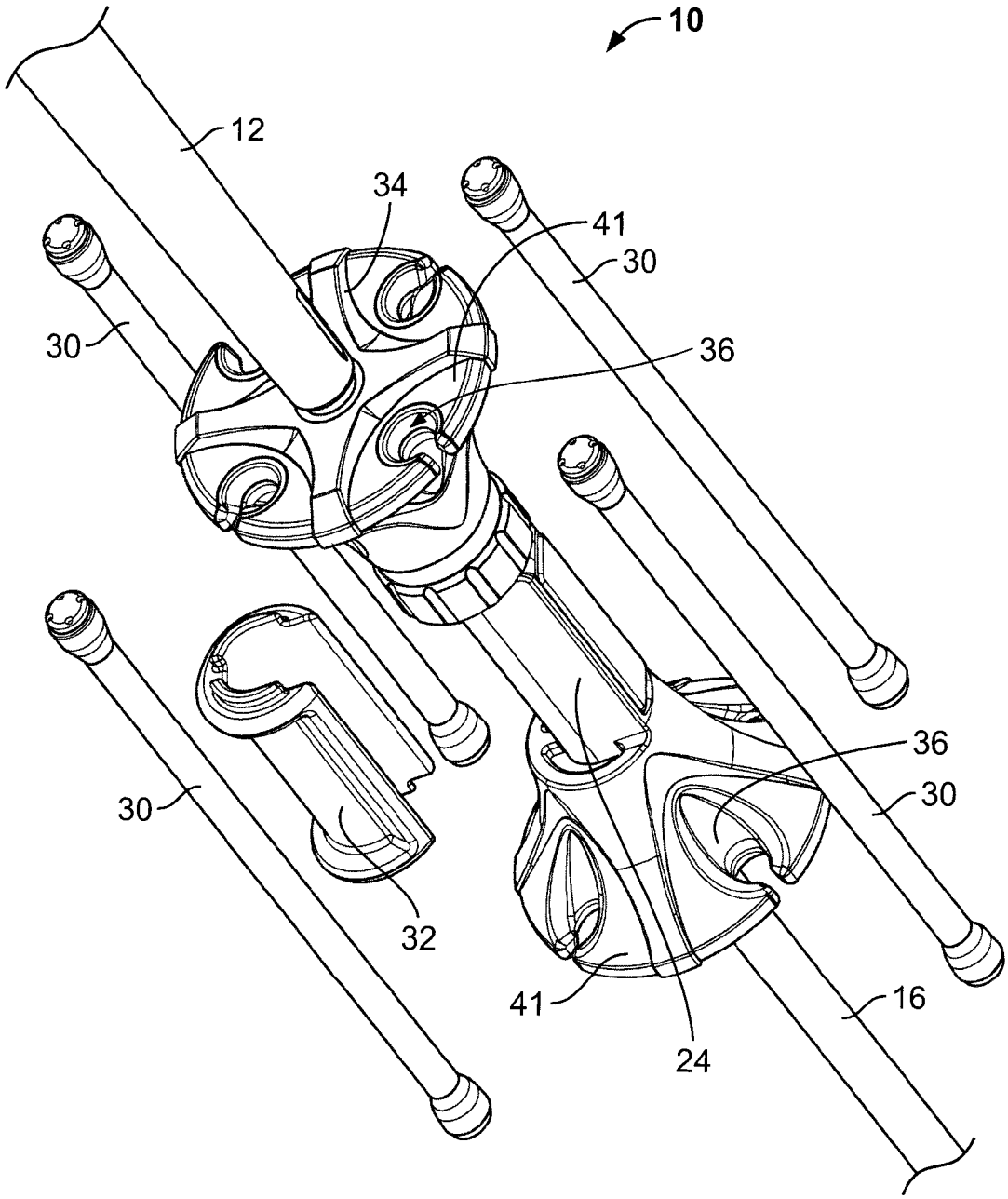
FIG. 2 shows a partly exploded view of a movable weight component and a biasing mechanism of the swing exercising apparatus.

FIGS. 1A to 1C show a swing exercising apparatus (10) in accordance with an embodiment of the invention. A user can swing the swing exercising apparatus (10) for improving a swing movement performed when practicing a sport (e.g., golf, tennis, baseball, cricket or hockey) or for other exercising purposes. In this embodiment, the swing exercising apparatus (10) comprises a handle (12), an elongated member (16), a movable weight component (22), a biasing mechanism (25), and a return mechanism (27).

The handle (12) can be grasped by the user in order to hold the swing exercising apparatus (10). In this embodiment, the handle (12) has a generally cylindrical shape that suits grasp by the hands of the user and has a length which is substantially shorter than a length of the elongated member (16). In other embodiments, the handle (12) may be of the same length as the elongated member (16) or may be longer than the elongated member (16). The handle (12) may have an outer portion made of material (e.g., rubber, leather, etc.) that enhances the grip by the hands of the user and that has a vibration suppressing effect.

The elongated member (16) has a proximal end (18) and a distal end (20), the proximal end (18) being adjacent to the handle (12). In this embodiment, the elongated member (16) comprises a single elongated component. More particularly, in this case, the elongated member (16) comprises a shaft, which may be solid or hollow and may be made of various materials (e.g., metal, plastic, composite). In other embodiments, the elongated member (16) may comprise a plurality of components that are interconnected to one another via one or more fasteners (e.g., bolts, welded joints, etc.) and that are made of various materials (e.g., metals, plastics, composites, etc.).

In some embodiments, the handle (12) and the elongated member (16) may be two separate components interchangeably connected to one another via one or more fasteners, such as screws, bolts, hooks, or other suitable fasteners, via a press-fit mechanism, or via any other suitable interconnection. In other embodiments, the handle (12) and the elongated member (16) may be permanently connected to one another via, for example, welding, glue, or other permanent attachments. In yet other embodiments, the handle (12) and the elongated member (16) may be integral with one another and constitute a common component.

While the handle (12) and the elongated member (16) are configured in a particular way in this embodiment, they may be configured in various other ways in other embodiments.

The movable weight component (22) is configured to move along the elongated member (16) when the user swings the swing exercising apparatus (10). More particularly, in this embodiment, the movable weight component (22) is slidably mounted on the elongated member (16). The movable weight component (22) defines a longitudinally extending opening for receiving the elongated member (16) and allowing the movable weight component (22) to slide along the elongated member (16). The opening is dimensioned to provide an appropriate clearance relative to the elongated member (16) with limited friction therebetween.

In this embodiment, the movable weight component (22) comprises a weight loading section (24) and a carriage section (26). In addition to its own weight, the weight loading section (24) is configured to accept a weight (32). For example, in some embodiments, the weight loading section (24) may weigh about 100 g, 150 g, 200 g, 250 g, 300 g, 350 g, 400 g, 450 g or 500 g and the weight (32) may weigh about 50 g, 100 g, 150 g, 200 g, 250 g, 300 g, 350 g, 400 g, 450 g, 500 g, 550 g, 600 g, 650 g, 700 g, 750 g or 800 g. This allows the user to adjust a total weight of the movable weight component (22). In some cases, the user can also use the swing exercising apparatus (10) without adding the weight (32) to the weigh loading section (24). Also, in other embodiments, the weight loading section (24) may be configured to accept more than one weight such as the weight (32) each of which may be individually installable and removable from the weight loading section (24) to allow the user to adjust a total weight of the movable weight component (22).

More specifically, in this embodiment, the weight loading section (24) of the movable weight component (22) has an overall substantially cylindrical shape with a portion thereof being configured for accepting a removable weight, such as the weight (32). In this case, at the proximal end of the weight (32) is a threaded cap with a tongue-and-groove mechanism. This cap can be screwed and unscrewed to the carriage section (26) to secure the weight (32) or remove and replace it at will.

Attachment of one or more weights such as the weight (32) to the weight loading section (24) may be achieved in various other ways in other embodiments. For example, in some embodiments, once the weight (32) is attached to the weight loading section (24) via the tongue-and-groove mechanism, it may be further secured to the loading section (24) through a secondary attachment mechanism. As another example, in some embodiments, the weight (32) may be secured to the weight loading section (24) through a clip-on mechanism, whereby the weight (32) is clipped onto the weight loading section (24) via complementary shapes of the weight (32) and the weight loading section (24). As yet another example, in some embodiments, the weight (32) may be coupled to the weight loading section (24) through magnetic interaction between a magnetic portion of the weight (32) and a magnetic portion of the weight loading section (24). The weight (32) may initially be oriented such that its magnetic portion is generally aligned with the magnetic portion of the weight loading section (24) such that the magnetic attraction between these magnetic portions would cause the weight (32) to become affixed to the weight loading section (24).

These examples of mechanisms that may be used to install the weight (32) to the weight loading section (24) are presented for illustrative purposes only as other mechanisms can be used in other embodiments. In addition, it will be appreciated that, in some embodiments, some of these mechanisms and/or other mechanisms may be combined to enhance weight attachment. For example, in some cases, the tongue-and-groove and the magnetic interaction mechanisms described above may both be used, such that when the extrusions at one lateral extremity of the weight (32) are brought into contact with the grooves in the weight loading section (24), the proximate nature of the two components at this position may cause magnetic attraction to 'snap' the weight (32) into place.

The carriage section (26) is configured to allow motion of the movable weight component (22) along the elongated member (16) and thus defines the opening in which is received the elongated member (16). In various embodiments, the weight loading section (24) and the carriage section (26) may be joined together permanently or may be detachably connected. Also, the weight loading section (24) and the carriage section (26) may be made from various materials, such as metals, plastics and composites.

While the moveable weight component (22) is configured in a particular way in this embodiment, it may be configured in various other ways in other embodiments.

Figure 5A:
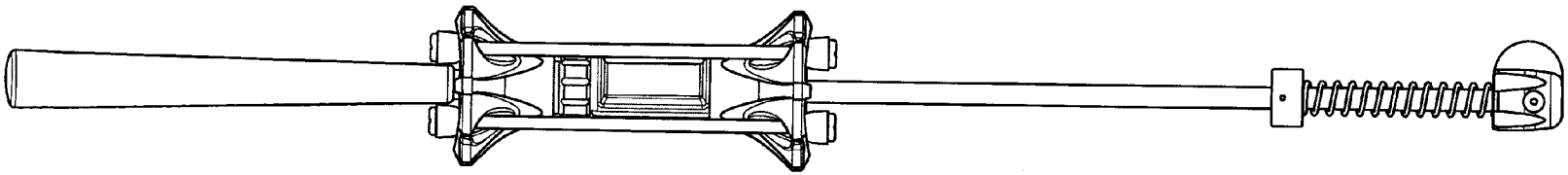
FIGS. 5A to 5D show examples of different positions of the movable weight component along an elongated member of the swing exercising apparatus when the user swings the swing exercising apparatus.
Figure 5B:
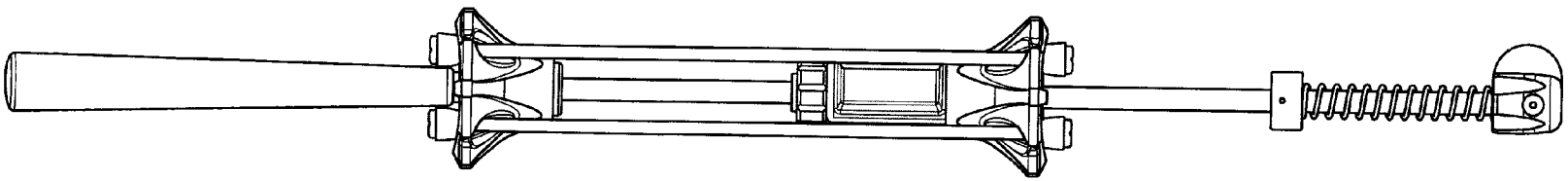
Figure 5C:
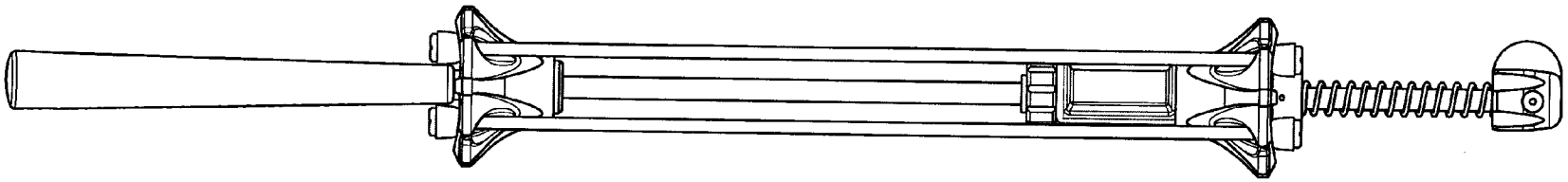
Figure 5D:
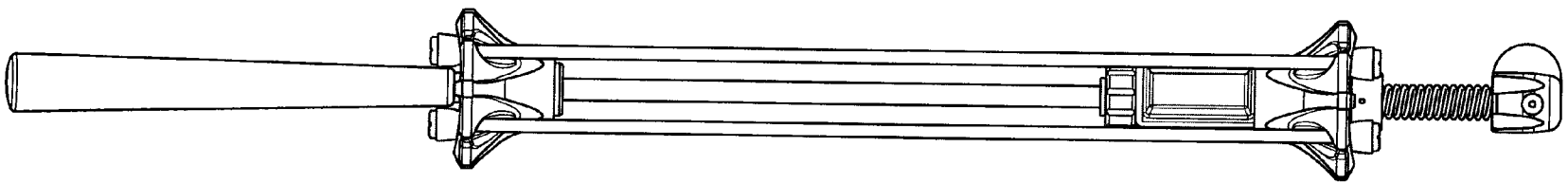

When the user swings the swing exercising apparatus (10), the movable weight component (22) moves along the elongated member (16) between a first position and a second position. The first position, which will be referred to as a "rest position", refers to the position of the movable weight component (22) along the elongated member (16) when the swing exercising apparatus (10) is not in use. An example of the rest position is shown in FIG. 5A. In this embodiment, when it is in the rest position, the movable weight component (22) abuts on a stationary member (34) mounted on the elongated member (16) at its proximal end (18). The second position, which will be referred to as an "apex position", refers to the position of the movable weight component (22) along the elongated member (16) that is furthest away from the rest position when the user swings the swing exercising apparatus (10). An example of the apex position is shown in FIG. 5D. Examples of intermediate positions of the movable weight component (22) between the rest position and the apex position are shown in FIGS. 5B and 5C.

The biasing mechanism (25) is designed to exert a force biasing the movable weight component (22) towards the rest position when the movable weight component (22) is located away from the rest position along the elongated member (16). For ease of reference, this force will be referred to as a "biasing force". In this embodiment, the biasing mechanism (25) comprises four elastic elements (30) to generate the biasing force. As further discussed later, when the user swings the swing exercising apparatus (10), the movable weight component (22) experiences a centrifugal force which causes it to move axially along the elongated member (16) away from the rest position. As the movable weight component (22) is located away from the rest position, the elastic elements (30) are extended and exert the biasing force biasing the movable weight component (22) towards the rest position. Thus, in addition to the weight being moved, the biasing force generated by the biasing mechanism (25) increases the resistance felt by the user as he/she swings the swing exercising apparatus (10).

The biasing force exerted by the biasing mechanism (25) depends on various factors. For example, the biasing force depends on factors such as the shape, dimension and composition of the elastic elements (30). Generation of the biasing force may also be influenced by other factors, such as the starting position of the swing exercising apparatus (10) when the user starts to execute a swing movement and the power provided to the swing exercising apparatus (10) by the user during the different segments of this swing movement (e.g., backswing and downswing segments).

More particularly, in this embodiment, each of the elastic elements (30) comprises an elastomeric tube (e.g., a latex tube), which may or may not be hollow. In this case, each elastomeric tube has a generally circular cross-section. In other cases, each elastomeric tube may have a cross-section with various other shapes (e.g., polygonal).

Various other types of elastic elements may be used to generate the biasing force in other embodiments. For example, in other embodiments, an elastic element may comprise an elastic band, a bungee cord, a spring, or any other elastic object that stores energy as it is deformed from an original state and restores the energy as it regains the original state. Also, while in this embodiment the biasing mechanism (25) comprises four elastic elements (30), in other embodiments, the biasing mechanism (25) may comprise one, two, three or any other number of elastic elements to generate the biasing force.

In this embodiment, the elastic elements (30) surround the elongated member (16), i.e., an imaginary closed line connecting the elastic elements (30) surrounds the elongated member (16). In other embodiments, the elastic elements (30) may be arranged in various other configurations relative to the elongated member (16).

The movable weight component (22) is linked to a stationary part of the swing exercising apparatus (10) via the biasing mechanism (25). More specifically, in this embodiment, the carriage section (26) of the movable weight component (22) is linked to the stationary member (34) by the elastic elements (30). Thus, when the user swings the swing exercising apparatus (10), the movable weight component (22) moves axially along the elongated member (16) away from the rest position and causes the elastic elements (30) to stretch. This stretching creates the biasing force biasing the movable weight component (22) back towards the rest position.

In this embodiment, the biasing mechanism (25) comprises an attachment portion (41) to which are attached the elastic elements (30). The attachment portion (41) allows the user to detach any of the elastic elements (30) to adjust the biasing force generated by the biasing mechanism (25). In other words, the attachment portion (41) enables the user to selectively detach any one of the elastic elements (30) and optionally attach at its place a different (e.g., larger, smaller, shorter, longer, less stretchable or more stretchable) elastic element. This allows the user to easily vary the biasing force generated by the biasing mechanism (25) and thus the overall resistance felt when swinging the swing exercising apparatus (10). In particular, this allows the magnitude of the biasing force generated at the beginning of the movement of the movable weight component (22) along the elongated member (16) and the magnitude of the biasing force generated at the end of the movement of the movable weight component (22) along the elongated member (16) to be independently adjusted.

The attachment portion (41) comprises respective attachment points (36) for the elastic elements (30). Some of the attachment points (36) are located on the stationary member (34), while other ones of the attachment points (36) are located on the movable weight component (22) such that, as the movable weight component (22) moves relative to this stationary member (34), the elastic elements (30) attached to the attachment points (36) can extend to exert the biasing force.

In this embodiment, each attachment point (36) forms an aperture to receive and hold an end portion of an elastic element (30). The aperture formed by each attachment point (36) accepts the elastic element (30) but is smaller than the end portion of the elastic element (30) in order to lock it into place. More particularly, in this embodiment, the attachment point (36) comprises a grommet through which the end portion of the elastic element (30) is plugged, thus forming a plug-and-grommet mechanism. The grommet may be made of a material (e.g., an artificial or natural rubber compound) to provide increased frictional resistance to the elastic element (30), which may decrease the likelihood of the elastic element (30) accidentally detaching itself during operation and thus unexpectedly vary the biasing force. The grommet may also provide additional protection for the elastic element (30) against any sharp edges within the stationary member (34) or the carriage section (26) that may possibly penetrate and cut it.

More specifically, in this embodiment, the elastic element (30) comprises a central part and a plug part at each lateral extremity. The circumferences of the central part and the plug part may differ such that the central part fits through a gap within the grommet, while the plug part would substantially fill the interior void of the grommet. In this way, the elastic element (30) can be inserted within and secured to both the stationary member (34) and the carriage section (26), resulting in the formation of a link between these two components.

For example, to attach an elastic element (30) to the movable weight component (22), its central part is fitted through the gap of the grommet of one of the attachment points (36) on the stationary member (34). The shape of the elastic element (30) can be modified to fit within this gap because since the elastic element (30) can be temporarily deformed in view of its elasticity. Once the elastic element (30) is suitably inserted in the aperture of the attachment point (36) on the stationary member (34), it is then pulled towards the corresponding attachment point (36) on the carriage section (26). This causes the plug part of the elastic element (30) at the stationary member (34) to come into contact with, and substantially occupy the grommet within the attachment point (36) on the stationary member (34). In addition, this may also cause the central part of the elastic element (30) to contract and deform, thus making it easier to pass it through the gap in the grommet of the corresponding attachment point (36) on the carriage section (26). When the central part of the elastic element (30) has passed through the aperture of the corresponding attachment point (36) on the carriage section (26), the elastic element (30) may be gradually released to allow its plug part to come into contact with and substantially occupy the grommet of the attachment point (36) on the carriage section (26). At this point, the elastic element (30) is suspended between the stationary member (34) and the carriage section (26) and may carry a certain amount of tension as a result. This attachment process may be repeated so that the remaining attachment points (36) are occupied by other elastic elements (30). However, while a plurality of attachment points (36) are provided, there is no requirement to attach elastic elements (30) to all of them. Also, elastic elements (30) providing the same amount of tension or different amounts of tension may be attached to the attachment points (36). In this way, the biasing force generated by the biasing mechanism (25) can be easily adjusted to the needs of the user.

Thus, the attachment portion (41) enables the user to easily and independently attach and detach any elastic element (30) to and from the movable weight component (22) and the stationary member (34).

While in this embodiment the attachment portion (41) comprises attachment points forming apertures to implement a plug-and-grommet mechanism allowing the user to selectively attach and detach any elastic element (30) of the biasing mechanism (25), in other embodiments, the attachment portion (41) may be configured in various other ways to allow the user to selectively attach and detach any elastic element (30) of the biasing mechanism (25). For example, in some embodiments, the grommet of the attachment point (36) discussed above may be replaced with a clip that includes a retractable portion that can be set to an open or closed position. To attach the elastic element (30), the retractable portion is set to its open position that allows the lateral extremity of the elastic element (30) to be inserted and attached to the stationary member (34) or the carriage section (26). Once the element (30) is secured, the retractable portion of the clip is set to its closed position that encircles the elastic element (30) ensuring that it cannot leave the attachment point (36) without some external action being performed on the clip. As another example, in some embodiments, the attachment portion (41) may comprise, for any elastic element (30), a hook, a shoulder or another structural part on which the elastic element (30) may be looped in order to secure it in place. Generally, the attachment portion (41) may comprise any component that allows the user to selectively attach or detach an elastic element (30) from the biasing mechanism (25) manually.

While the biasing mechanism (25) is configured in a particular way in this embodiment, it may be configured in various other ways in other embodiments.

The return mechanism (27) comprises an elastic element (40) for exerting a force on the movable weight component (22) when the movable weight component (22) compresses the elastic element (40) of the return mechanism (27). For ease of reference, this force will be referred to as a "restoring force". The restoring force exerted by the return mechanism (27) acts to decelerate the movable weight component (22) and contributes to return the movable weight component (22) towards the rest position. The magnitude of the centripetal force increases proportionally to the compression of the elastic element (40) by the movable weight component (22), thereby increasing the resistance felt by the user. The magnitude of the centripetal force can be adjusted by varying the shape, dimension and force constant of the elastic element (40).

Additionally, the return mechanism (27) and the restoring force it generates act to dampen any shock that can be felt by the user when the movable weight component (22) hits the elastic element (40) by slowing down the movable weight component (22) instead of abruptly stopping it. That is, the return mechanism (27) controls the speed with which the movable weight component (22) is stopped and the distance on the elongated member (16) over which the movable weight component (22) is stopped. In addition, the elastic element (40) conserves energy it stores in stopping the movable weight component (22) and then returns it to the user as it regains its original state. In that sense, the return mechanism (27) can be viewed as an energy conservation mechanism. This conservation of energy has the effect of increasing a rotational speed of the swing exercising apparatus (10) once the movable weight component (22) changes direction along the elongated member (16). In contrast, if an element that dissipated energy was used instead of the return mechanism (27), the increase in speed that would occur with a follow-through of the swing would be less than that achieved with the elastic element (40) of the return mechanism (27).

In this embodiment, the elastic element (40) comprises a coil spring located at a free outer end (14) of the swing exercising apparatus (10), more specifically at the distal end (20) of the elongated member (16). The coil spring is installed coaxially on the elongated member (16) and retained thereon by a radially projecting shoulder (42) at one end of the coil spring and by a capping element (44) at the distal end (20) of the elongated member (16). The coil spring, when hit by the incoming movable weight component (22), helps to prevent undesirable vibrations in the elongated member (16) before stopping the movable weight component (22) entirely. In some cases, a variable force spring (i.e., with a variable pitch) may be used to offer more force if desired.

In other embodiments, various other types of elastic elements may be used to generate the restoring force exerted by the return mechanism (27). For example, in other embodiments, the elastic element (40) may comprise a block of elastic material that stores energy as it is compressed from an original state and restores the energy as it regains the original state. Also, while in this embodiment the return mechanism (27) comprises one elastic element (40), in other embodiments, the return mechanism (27) may comprise two, three or any other number of elastic elements, of the same or different force constant, to generate the restoring force.

In some embodiments, the return mechanism (27) may be configured to allow the user to adjust the restoring force that it is capable of exerting. For instance, in some cases, the return mechanism (27) may allow the elastic element (40) to be removed and replaced by a different elastic element, and/or may allow its location along the elongated member (16) to be adjusted.

While the return mechanism (27) is configured in a particular way in this embodiment, it may be configured in various other ways in other embodiments.

Figure 3:
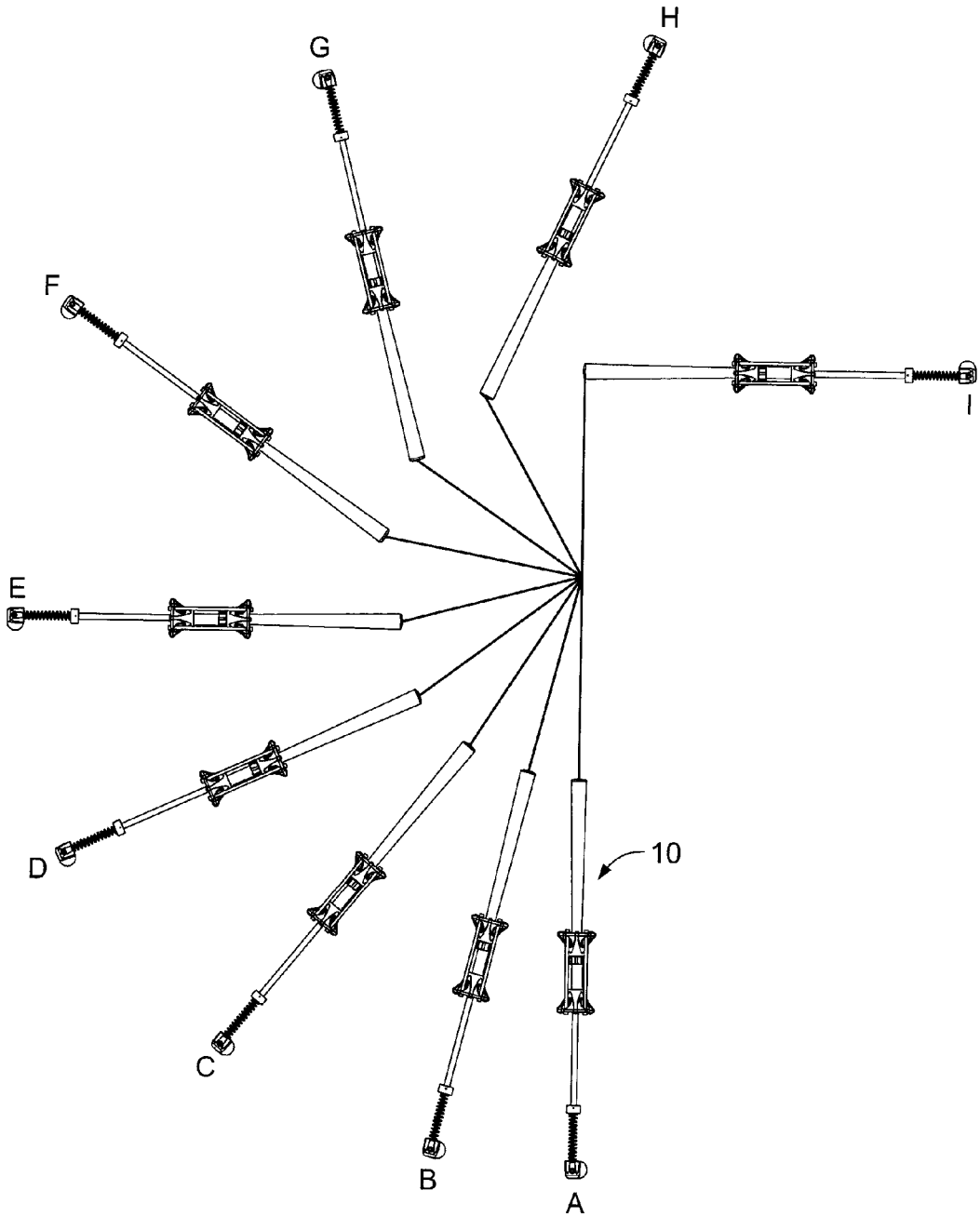
FIGS. 3 and 4 show a diagrammatic representation of an example of a swing movement performed by a user using the swing exercising apparatus, including a backswing segment, a downswing segment and a follow-through segment.
Figure 4:
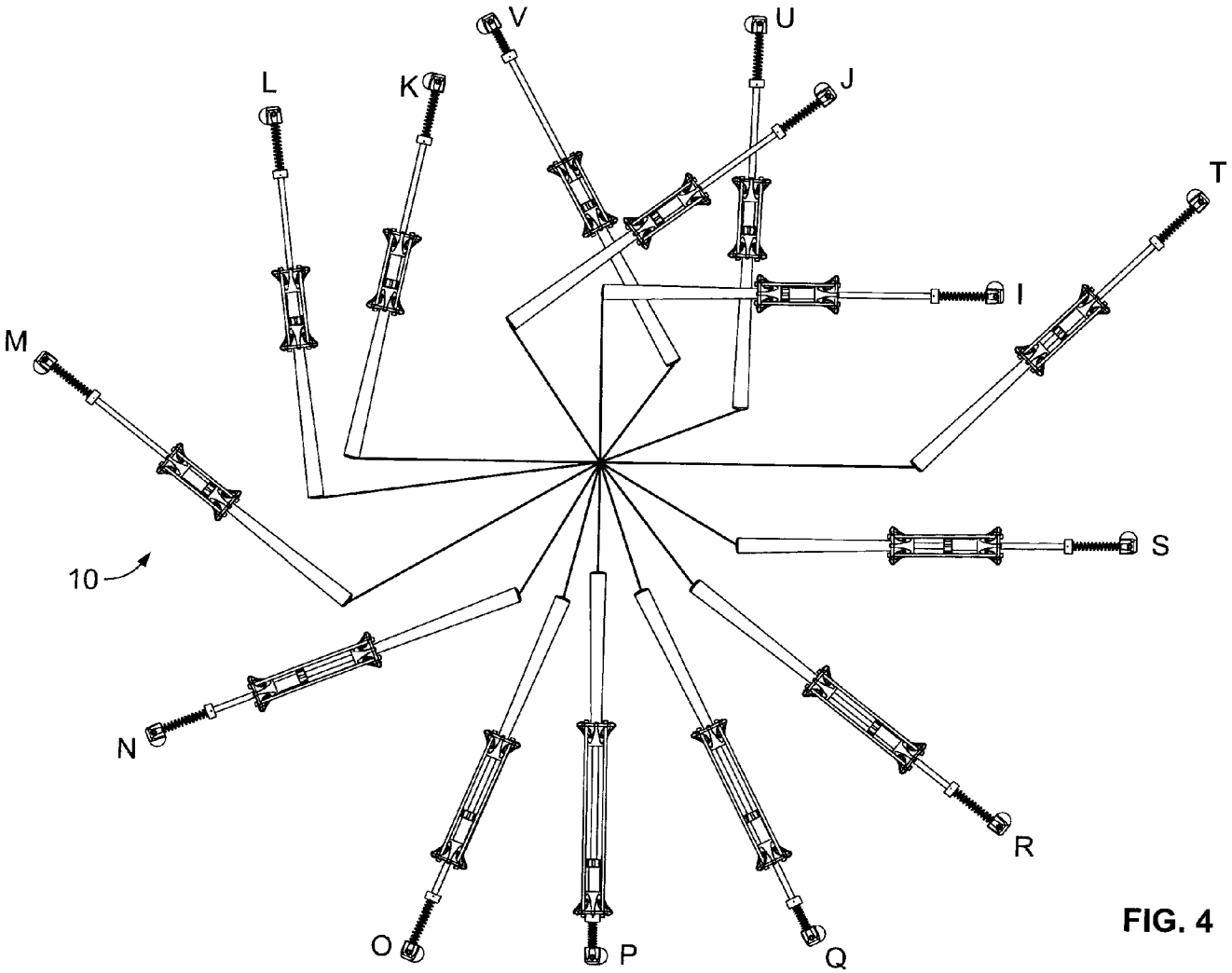

In use, the user places his hands on the handle (12) of the swing exercising apparatus (10) so as to grasp the handle (12). The user proceeds to swing the swing exercising apparatus (10). An example of such a swing is shown in FIGS. 3 and 4. In this example, the user initially swings the swing exercising apparatus (10) backward, as diagrammed through successive positions A through I as shown in FIG. 3. This imparts no or very little translational motion to the movable weight component (22) along the elongated member (16). The user then proceeds with a downswing, as diagrammed in FIG. 4 for successive positions J through P, and then with a follow-through, as diagrammed in FIG. 4 for successive positions Q through V. As seen in FIG. 4, the movable weight component (22) slides along the elongated member (16) under the centrifugal force generated by the downswing towards the outer free end (14) of the swing exercising apparatus (10).

Thus, a swing movement performed by the user can be viewed as including three parts, namely a backswing, a downswing and a follow-through. The backswing refers to the part of the swing movement in which the swing exercising apparatus (10) moves backward, away from its starting point, in preparation for the downswing (positions A to I at FIG. 3). The downswing (which can also be called a forward swing) refers to the part of the swing movement in which the swing exercising apparatus (10) moves downward (forward) from the end of the backswing until it reaches once again it starting point (positions J to P at FIG. 4). The follow-through refers to the part of the swing movement in which the swing exercising apparatus (10) continues to moves beyond the starting position due to momentum gained during the downswing (positions Q to V at FIG. 4).

During the downswing, the outer free end (14) of the swing exercising apparatus (10) is accelerated at the same time that the elastic elements (30) of the biasing mechanism (25) are being stretched by movement of the movable weight component (22) (the elastic elements (30) being attached to the stationary member (34) which itself does not move during the swing movement). The user experiences a progressively increasing resistance to his/her swing. In this example, during the swing movement, the movable weight component (22) reaches its apex position along the elongated member (16) when the outer free end (14) of the apparatus arrives at the position "P" (see FIGS. 3 and 4), which may correspond to the position in a swing where an implement swung during the practice of a sport would come in contact with an object to be hit (e.g., in the case of a golf swing, when the head of a golf club hits a golf ball on the ground, in the case of a tennis swing, when the head of a tennis racket hits a tennis ball, etc.).

It will be understood that depending on the strength of the user, the type of elastic elements (30), as well as the weight of the movable weight component (22) being used, the apex position of the movable weight component (22) may or may not coincide with the location of the return mechanism (27). In other words, the movable weight component (22) may not necessarily always reach the return mechanism (27) at the position "P" of the swing movement. In some cases, the movable weight component (22) may reach its apex position along the elongated member (16) before or after the position "P".

The swing exercising apparatus (10) may be adjusted so that, at the point "P" of the swing, the movable weight component (22) compresses partly or totally the elastic element (40) of the return mechanism (27), resulting in the user experiencing both the biasing force exerted by the biasing mechanism (25) and the restoring force exerted by the return mechanism (27). When the movable weight component (22) comes in contact with the elastic element (40) and compresses it, the elastic element (40) absorbs the shock of the incoming movable weight component (22) to prevent undesirable vibrations in the elongated member (16) before stopping it entirely. Then, the elastic element (40) assists in returning the movable weight component (22) along the elongated member (16) back towards its rest position during the follow-through part of the swing.

Alternatively, the swing exercising apparatus (10) may be adjusted so that, at the point "P" of the swing movement, the movable weight component (22) does not compress the elastic element (40). In this situation, the user experiences the biasing force exerted by the biasing mechanism (25), but not the restoring force capable of being exerted by the return mechanism (27).

Thus, in this embodiment, the biasing mechanism (25) and the return mechanism (27) generate respective forces that cause the movable weight component (22) to be biased towards and return to its rest position and that create resistance to the swing movement of the user, thereby exercising the user. This has the effect on the user of increasing the effort required to accelerate and decelerate the swing exercising apparatus (10).

When the swing is initialized, the swing exercising apparatus (10) is easier to swing since the movable weight component (22) is located at the rest position, near the handle (12), thus reducing the torque required to swing the apparatus (see FIG. 5A). As the swing exercising apparatus (10) is swung, the movable weight component (22) moves along the elongated member (16) (see FIG. 5B). Eventually, the movable weight component (22) may reach and contact the return mechanism (27) (FIG. 5C). The movable weight component (22) may then compress the elastic element (40) of the return mechanism (27) until it comes to a complete stop (see FIG. 5D). During the follow-through part of the swing, the movable weight component (22) returns to its rest position under the effect of the biasing force exerted by the biasing mechanism (25) and, if applicable, the restoring force exerted by the return mechanism (27).

In some situations, the movable weight component (22) does not reach the return mechanism (27), in which case the biasing force exerted by the biasing mechanism (25) acts on the movable weight component (22), but not the restoring force capable of being exerted by the return mechanism (27), which may also be beneficial to the training of the user. Therefore, the apex position of the movable weight component (22) during the swing movement need not necessarily be at the outer free end (14) of the apparatus (10). For instance, depending on how fast and with how much power the user swings the swing exercising apparatus (10), the apex position of the movable weight component (22) may lie anywhere between its rest position near the handle (12) and the outer free end (14) of the apparatus (10).

The swing exercising apparatus (10) can allow the user to adjust the resistance experienced as he/she swings the swing exercising apparatus (10).

One way of adjusting the resistance experienced by the user as he/she swings the swing exercising apparatus (10) is by varying the weight of the movable weight component (22). For example, adding or removing one or more weights on the movable weight component (22) not only influences the displacement of the movable weight component (22) along the elongated member (16), but also influences the overall maneuverability of the swing exercising apparatus (10) when it is swung. Adjustment of the resistance may also be achieved by varying the rest position of the movable weight component (22) along the elongated member (16) so as to vary a moment of inertia the user feels at different parts of the swing movement.

Another way of adjusting the resistance experienced by the user as he/she swings the swing exercising apparatus (10) is by modifying the biasing force exerted by the biasing mechanism (25). For example, this can be accomplished by adding or removing one or more elastic elements (30) and/or replacing one or more elastic elements (30) by one or more other elastic elements having a different elasticity. A thicker and/or shorter elastic element can offer more resistance than a thinner and/or longer elastic element. Also, elastic elements made of different material may offer different degrees of resistance. In this embodiment, the attachment portion (41) of the biasing mechanism (25) facilitates attachment or detachment of any elastic element (30).

With the above-mentioned ways to adjust the resistance created by swing exercising apparatus (10), it becomes possible for the user to adjust the swing exercising apparatus (10) such that the movable weight component (22) reaches the return mechanism (27) at a desired point of the swing movement (e.g., the point "P" discussed above).

Yet another way of adjusting the resistance experienced by the user as he/she swings the swing exercising apparatus (10) is by modifying the restoring force capable of being exerted by the return mechanism (27). For example, the restoring force may be adjusted by varying the initial compression of the elastic element (40), by varying the force constant of the elastic element (40), by varying the length of the elastic element (40) and/or by varying the location of the elastic element (40) along the elongated member (16). The closer the elastic element (40) is to the distal end (20) of the elongated member (16) and therefore from the movable weight component (22) in its rest position, the greater the distance the movable weight component (22) has to move along the elongated member (16) to reach the return mechanism (27).

In some embodiments, in addition to being able to adjust a total weight of the movable weight component (22), it may also be desirable to adjust a fixed weight on the elongated member (16). Such weight adjustment can be done, for example, by attaching one or more static weights along the elongated member (16) or within the elongated member (16). For example, the elongated member (16) may comprise a static weight attachment portion including one or more static weight attachment points at which one or more static weight may be attached along the elongated member (16). This provides the swing exercising apparatus (10) with versatility that weight on the movable weight component (22) alone may not offer. Increasing the weight on the movable weight component (22) allows to adjust the moment of inertia. Having weights that are static at one or more places on the swing exercising apparatus (10) may allow to fine tune the movement of inertia that the user feels at the beginning of the swing and when the weight is put at the distal end of the swing exercising apparatus (10).

Figure 6:
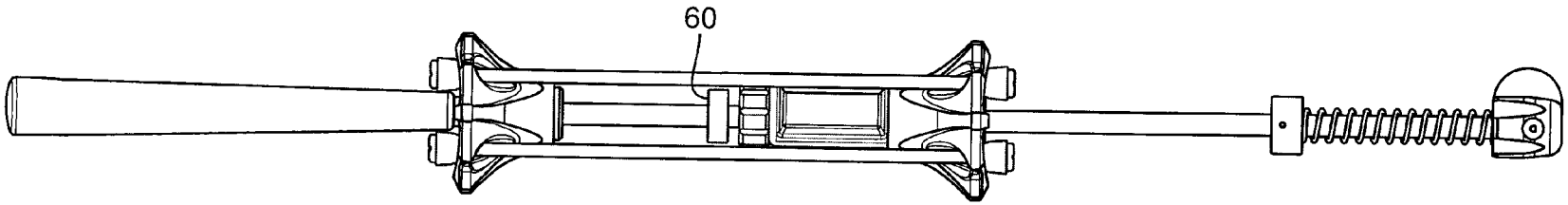
FIG. 6 shows an embodiment of the swing exercising apparatus where a rest position of the movable weight component is adjusted on the elongated member to be closer to the distal end of the elongated member.

In some embodiments, in addition or as an alternative to adjusting weight on the swing exercising apparatus (10), another method that can be used to adjust the moment of inertia is to vary the rest position of the movable weight component (22) on the elongated member (16). For example, as shown in FIG. 6, in some embodiments, a rest position adjustor (60) may be used to adjust the rest position of the movable weight component (22) along the elongated member (16). As shown, the rest position of the movable weight component (22) has been adjusted closer to the distal end (20) of the elongated member (16) than that shown in FIG. 5A. In this case, the rest position adjustor (60) comprises a spacer element that that can be placed at one or more locations along the elongated member (16) to set the rest position of the movable weight component (22) by lock it into place. For instance, the rest position adjustor (60) may be a pin and the elongated member (16) may define one or more holes in which the pin may be inserted to lock the movable weight component (22) into place. The rest position adjustor (60) may be implemented in various other ways in other embodiments.

Another method of adjusting the moment of inertia is to move both the stationary member (34) and the movable weight component (22) together to a different point more distally or more proximally on the elongated member (16), thereby keeping the length of the elastic elements (30) the same. This can be achieved using a position adjustor to adjust the positions of both the stationary member (34) and the movable weight component (22) along the elongated member (16). For instance, the position adjustor may be a pin on the stationary member (34) and the elongated member (16) may define one or more holes in which the pin may be inserted to lock the stationary member (34) into place.

It will thus be appreciated that the swing exercising apparatus (10) provides a variable resistance that can be used to increase the speed and power of the swing movement of the user. The variable resistance can help to remedy certain common biomechanical swing faults in the swing movement such as reducing casting or early release of the swing apparatus.

The resistance or inertia is variable because the moment of inertia of the swing exercising apparatus (10) increases from the beginning to the end of the swing movement. The swing exercising apparatus (10) may thus be effective at increasing swing speed because of this variable resistance. The variable resistance is a type of responsive resistance in that the inertia can increase as a function of speed. That is, the faster the swing, the farther out the movable weight component (22) goes and the more inertia that will be encountered by the user. The swing exercising apparatus (10) also allows the user to achieve high swing speeds at the initiation of the swing movement when the moment of inertia is less, and high contraction forces and high power toward the end of the swing movement when the moment of inertia is great. Achieving high contraction forces at high swing speeds is key in increasing speed in swing movements. As the swing exercising apparatus (10) is swung repeatedly by the user in order to condition and train his/her muscles, this will then translate to increasing the swing speed of the swing movement.

Besides performing a swing movement with large amplitude, the swing exercising apparatus (10) may also be useful for rapid swing movements of lower amplitude, such as rapid "back and forth" movements which can be performed for exercising or workout purposes.

Various modifications and enhancements may be made to the swing exercising apparatus (10) in various embodiments.

Figure 7:
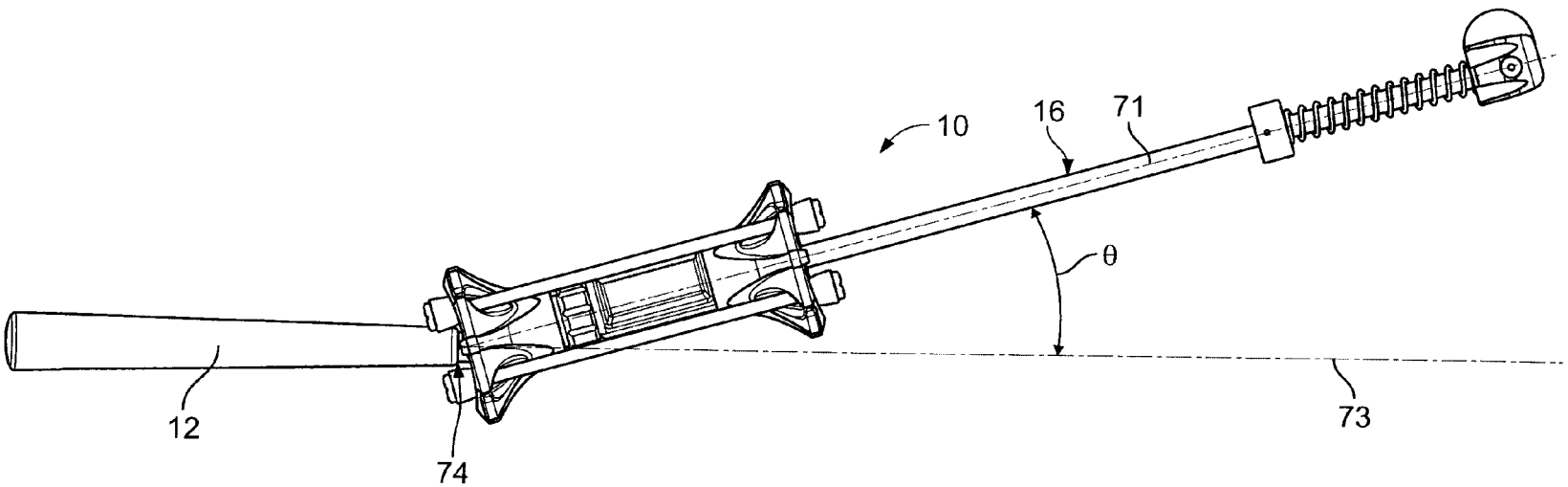
FIG. 7 shows an embodiment of the swing exercising apparatus where the elongated member is angled with respect to a longitudinal axis of a handle of the swing exercising apparatus.

For example, FIG. 7 illustrates an embodiment in which the elongated member (16) is configured such that, when the movable weight component (22) moves along the elongated member (16) as the user swings the swing exercising apparatus (10), the movable weight component (22) follows a path diverging from a longitudinal axis (73) of the handle (12). This imparts to the user a progressively increasing resistance as the handle (12) is rotated about its longitudinal axis (73) during the swing movement because of an increase in the moment of inertia resulting from the movable weight component (22) moving away from the longitudinal axis (73) of the handle (12). In turn, this may allow the user to practice and/or strengthen his/her ability to rotate the outer distal end of the swing exercising apparatus (10). For example, a golfer using the swing exercising apparatus (10) configured in this way can strengthen his/her ability to rotate the clubface of a golf club into a more closed position.

More particularly, in this embodiment, the elongated member (16) is angled relative to the handle (12). That is, a longitudinal axis (71) of the elongated member (16) lies at a nonzero angle θ with respect to the longitudinal axis (73) of the handle (12). The angle θ may take on various values. For example, in some cases, the angle θ may be between about 5 degrees to about 60 degrees.

The elongated member (16) diverges from the longitudinal axis (73) of the handle (12) at a vertex point (74). In some embodiments, the vertex point (74) may comprise a bending point. For example, in cases where the handle (12) and the elongated member (16) are integral with one another and constitute a single component, the vertex point (74) may comprise a bent portion of this single component. In other embodiments, the vertex point (74) may comprise a connection point at which the elongated member (16) is fastened fitted, or otherwise connected at the nonzero angle θ to the handle (12). In some cases, this connection point may be a pivot point that allows the elongated member (16) to be pivoted with respect to the handle (12) in order to be positioned at the nonzero angle θ. A locking element may then be used to lock the elongated member (16) at that angle. The pivot point and the locking element may allow the elongated member (16) to be positioned and locked at various values of the nonzero angle θ depending on the user's needs. In yet other embodiments, the vertex point (74) may comprise a connector having two ends onto which can be respectively mounted the handle (12) and the elongated member (16) and which forms the nonzero angle θ. Individual connectors with different angles may be used interchangeably to vary the resistance.

While in the embodiment considered above, an entirety of the elongated member (16) is angled relative to the handle (12), in other embodiments, there may be a section of the elongated member (16) that remains generally parallel to the longitudinal axis (73) of the handle (12) while another section of the elongated member (16) lies at the nonzero angle θ to the longitudinal axis (73) of the handle (12). Also, while in the embodiment considered above the elongated member (16) is generally straight, in other embodiments, the elongated member (16) may be curved so as to provide the path of the movable weight component (22) that diverges from the longitudinal axis (73) of the handle (12).

Figure 8:
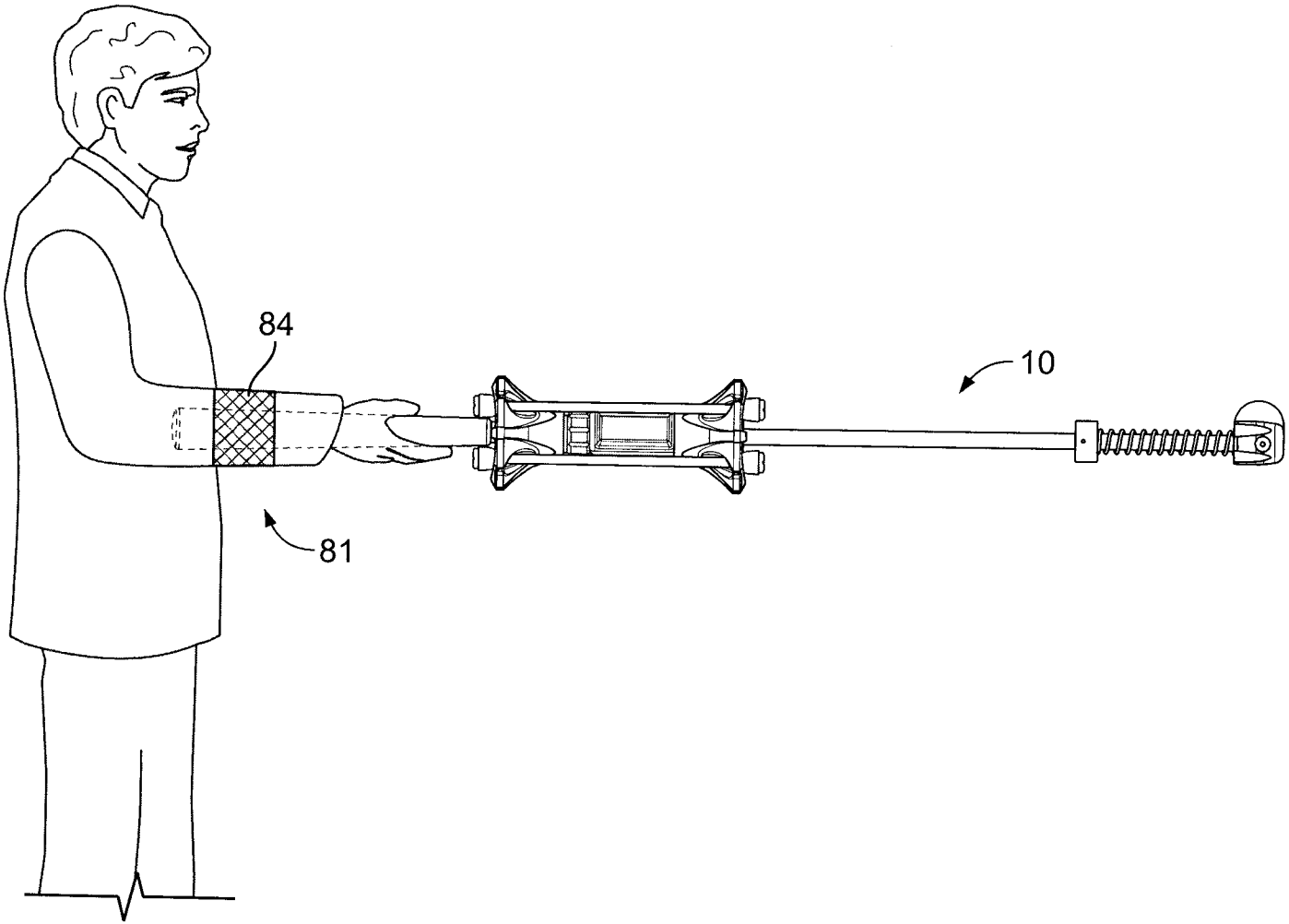
FIG. 8 shows an embodiment of the swing exercising apparatus comprising an arm attachment for attaching the swing exercising apparatus to an arm of the user.

FIG. 8 illustrates an embodiment in which the swing exercising apparatus (10) comprises an arm attachment (81) for attaching an arm of the user to the handle (12). The arm attachment (81) comprises an arm engaging portion (84) for engaging the arm of the user in a region remote from a wrist of the user to reduce stress on the wrist of the user when the arm of the user swings the swing exercising apparatus (10). This can allow the user to exercise his triceps, biceps, elbow and/or the shoulder muscles in a combined or isolated manner. In particular, using the arm attachment (81) can inhibit flexion, extension and bending of the wrist of the user in any direction while performing the exercise. Thus, when using the arm attachment (81), the wrist of the user can be subjected to isometric resistance and be under isometric contraction, in which the joint angle and the muscle length do not substantially change during the contraction.

More particularly, in this embodiment, the arm attachment (81) is mounted to the handle (12) of the swing exercising apparatus (10). For example, the arm attachment (81) may be fixed to the handle (12) via one or more fasteners or a sowed connection. In other cases, the arm attachment (81) may be integral with the handle (12).

The arm engaging portion (84) receives a portion of the arm of the user that is remote from his/her wrist. In this embodiment, the arm engaging portion (84) receives a forearm portion of the user that is adjacent to an elbow of the user. In other cases, the arm receiving portion (84) may receive a portion of the arm of the user that is between the elbow and a shoulder of the user.

The arm engaging portion (84) is sized to accommodate the arm of the user. For example, in some embodiments, the arm engaging portion (84) may comprise a strap (e.g., a Velcro™ strap) to be strapped to the arm of the user. Other elements may be used to accommodate the arm of the user such as, for example, a lace, a thread, a fastening element such as a clip, a hook, or other types of fastening elements. The arm engaging portion (84) should fit the arm of the user so that it is not so tight that it tires the muscles of the arm and creates pain upon usage and not too loose so that the arm could slip out of the arm attachment (81) upon practicing the swing movement. The arm engaging portion (84) may be made of various materials. For instance, in some embodiments, the arm engaging portion (84) may be made of polymer material, textile, fabric, or any combination thereof.

In use, the arm of the user is inserted through the properly adjusted arm engaging portion (84) of the arm attachment (81). This permits a forearm portion of the arm between the wrist and the arm engaging portion (84) to be aligned with the longitudinal axis (73) of the handle (12). In some cases, the handle (12) may be in contact with the skin of the user. With the arm attachment (81), the user does not have to firmly grip the handle (12) of the swing exercising apparatus (10) with his/her hand in order to swing the apparatus (10). While the user can hold the handle (12), he/she does not have to exert significant effort using his/her wrist during the swing movement since the arm attachment (81), which acts in a region remote from his/her wrist, serves to firmly attach the swing exercising apparatus (10) to the arm of the user.

While the arm attachment (81) is configured in a particular way in this embodiment, it may be configured in various other ways in other embodiments.

Figure 11A:
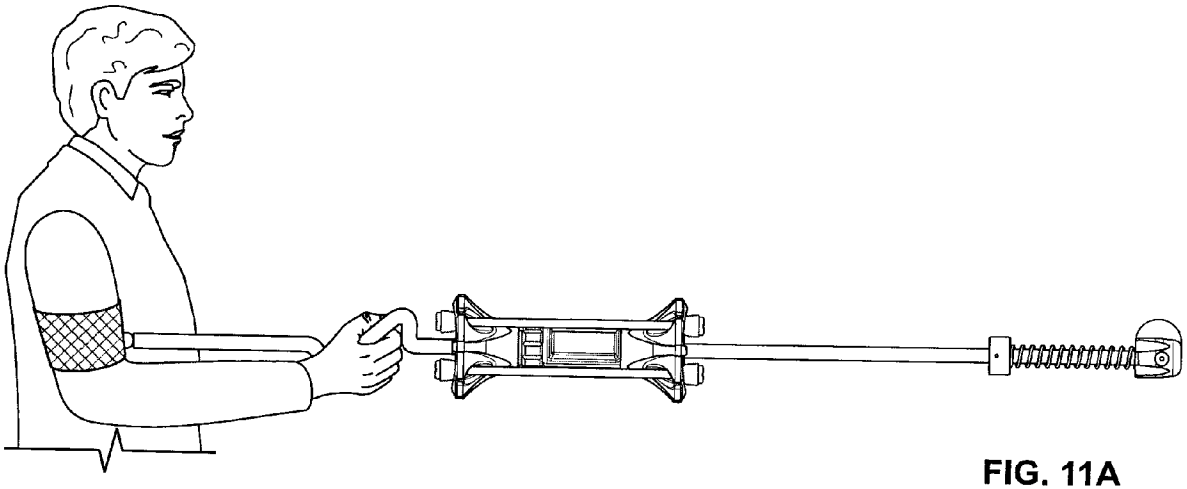
Figure 11B:
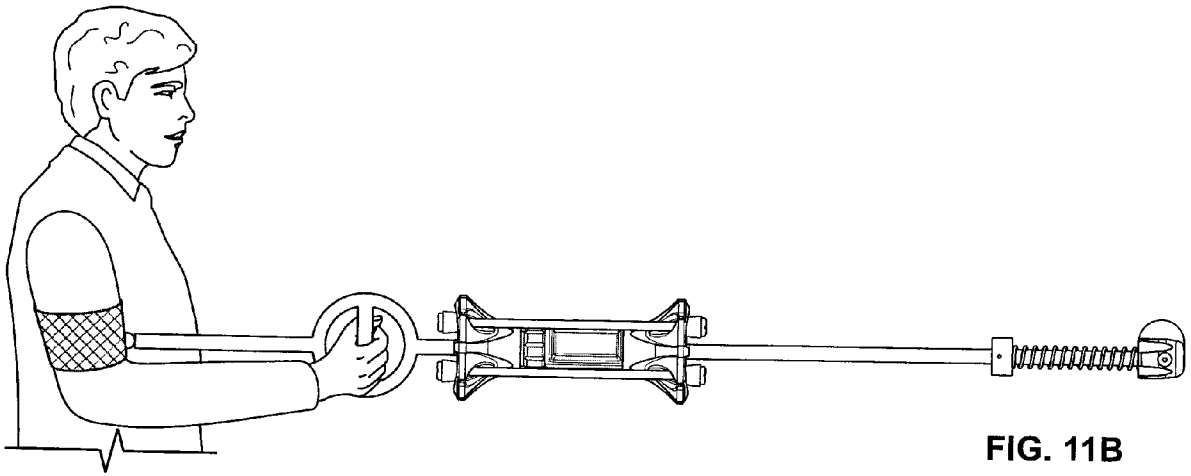

FIGS. 11A and 11B show further embodiments of the arm attachment. In these embodiments, the arm engaging portion receives the arm of the user that is between the shoulder and the elbow. The hand of the user is free to grasp the handle configured to accommodate the hand of the user. A swing movement (e.g., a back-and-forth movement) can be performed with the elbow bent or not. The user can thus train bending movements at the elbow. The user can also train any kind of movement at the shoulder, including abduction, adduction, flexion, extension, as well as internal and external rotation. In the embodiment shown in FIG. 11A a segment of the handle is bent so as to facilitate grasping by the hand of the user. In the embodiment shown in FIG. 11B, the handle comprises a circular segment having a bar diametrically installed within, perpendicular to the longitudinal axis of the handle, and suitable for grasping by the hand of the user.

While in the embodiments considered above, the movable weight component (22), the biasing mechanism (25) and the return mechanism (27) are located on an outer side of the elongated member (16), in other embodiments, the elongated member (16) may define a hollow interior space and the movable weight component (22), the biasing mechanism (25) and/or the return mechanism (27) may be located within the interior space of the elongated member (16).

Figure 10:
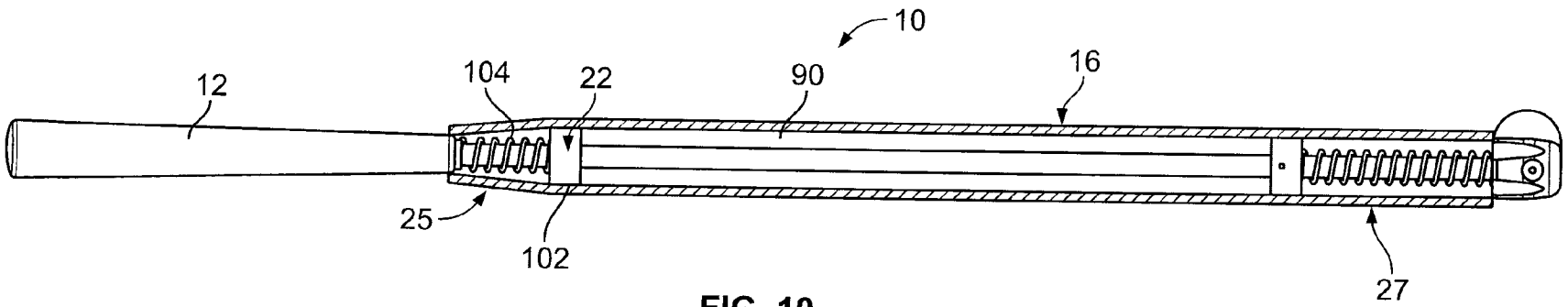

For example, FIG. 10 illustrates an embodiment where the elongated member (16) defines a hollow interior space (90) in which the movable weight component (22), the biasing mechanism (25) and the return mechanism (27) are located. In this embodiment, the movable weight component (22) comprises a weight (102) that can move in along the elongated member (16) in its interior space (90). Also, in this embodiment, the biasing mechanism (25) comprises a spring (104) disposed to bias the weight (102) towards the proximal end (18) of the elongated member (16). The elongated member (16) and the handle (12) may de detachably connected so as to allow the user to separate the handle (12) and the elongated member (16) to replace the weight (102) with a lesser or greater weight.

Figure 9A:
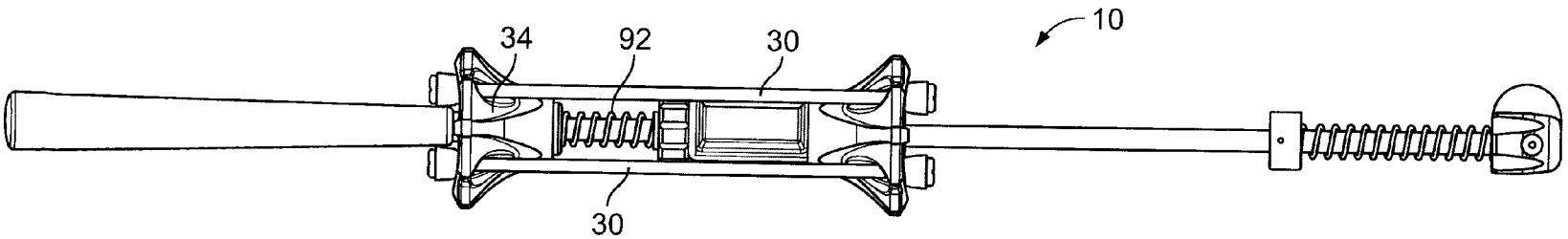
FIGS. 9A and 9B, FIG. 10 and FIGS. 11A and 11B show different embodiments of the swing exercising apparatus.

In some embodiments, the biasing mechanism (25) may comprise different types of elastic elements to generate the biasing force. For example, FIG. 9A shows an embodiment in which the biasing mechanism (25) comprises, in addition to the elastomeric tubes (30), a coil spring (92) connected to the stationary member (34) and to the movable weight component (22). The spring (92) is extended upon movement of the movable weight component (22) along the elongated member (16), thereby generating part of the biasing force.

Figure 9B:
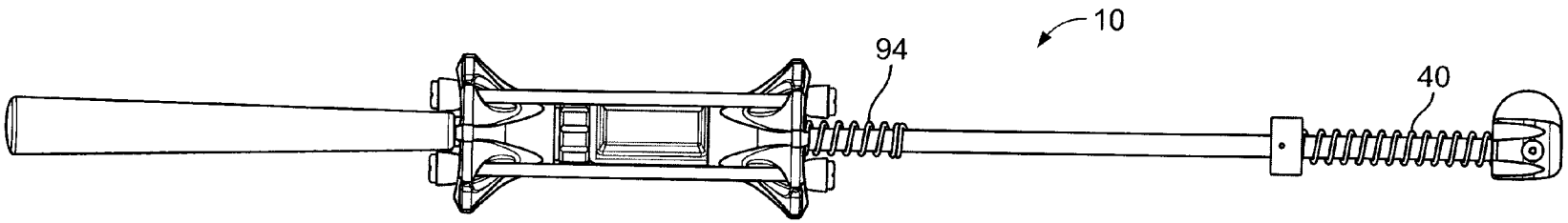

In some embodiments, part or all of the return mechanism (27) may be movable along the elongated member (16). For example, FIG. 9B shows an embodiment in which a coil spring (94) is located on the distal end part of the movable weight component (22) and moves along the elongated member (16) with the movable weight component (22). In this case, when the spring (94) reaches the elastic element (40), both the spring (94) and the elastic element (40) may be compressed to generate the restoring force acting to decelerate the movable weight component (22) and then contribute to return it towards its rest position. As an alternative to the embodiment shown in FIG. 9B, in some cases, the elastic element (40) may be omitted from the distal end of the elongated member (16). This may allow a reduction of the static weight at the distal end of the swing exercising apparatus (10), if such static weight at the distal end of the apparatus (10) is undesired.

In some embodiments, the elongated member (16) may be a telescoping elongated member. More particularly, in such embodiments, the elongated member (16) may comprise a first portion and a second portion that is telescopically movable with respect to the first portion. For example, in one embodiment, the first portion of the elongated member (16) defines a hollow interior space in which is slidably installed the second portion of the elongated member (16) such that the second portion of the elongated member (16) can extend and retract in a longitudinal direction from the handle (12). The first and second portions of the elongated member (16) are interconnected via a biasing mechanism that comprises at least one elastic element to bias them towards one another. A movable weight component is installed on the second portion of the elongated member (16). When the user performs a swing movement, the second portion of the elongated member (16) moves longitudinally relative to the first portion of the elongated member (16). This causes the movable weight component mounted to the second portion of the elongated member (16) to also move longitudinally relative to the first portion of the elongated member (16) and to be biased back towards its rest position by the biasing mechanism.

In some embodiments, the handle (12) may be configured as a golf club handle, a hockey stick handle, a baseball bat handle, a cricket bat handle, or a racquet handle, such as a tennis racquet handle, a badminton racquet handle, a squash racquet handle or a racquetball racquet handle. The handle (12) can also be of various other shapes or sizes such as, a sword handle, an axe handle etc. In some cases, the handle (12) may be interchangeably coupled to the elongated member (16) to allow it to be removed and replaced by a different handle. For example, the handle (12) may be screwed or otherwise secured to the elongated member (16) to facilitate its replacement by the user.

In some embodiments, a hitting element may be mounted at the outer free end (14) of the swing exercising apparatus (10) to simulate a hitting element of any sport implement. For example, the hitting element mounted to the swing exercising apparatus (10) may be configured as a golf club head element, a hockey stick blade element, etc. In some cases, the hitting element may be interchangeably coupled to the elongated member (16) to allow it to be removed and replaced by a different hitting element. For example, the hitting element may be screwed or otherwise secured to the elongated member (16) to facilitate its replacement by the user.

In some embodiments, the swing exercising apparatus (10) may comprise an indicator, which can be auditory, visual or both, indicating when the movable weight component (22) reaches the return mechanism (27) or some other predefined point. For example, in some cases, an auditory cue may happen when the movable weight component (22) hits the projecting shoulder (42) mounted on the elongated member (16). The sound then created is loud enough to be heard by the user and to serve as an auditory cue. In some other cases, the swing exercising apparatus (10) may comprise a bell that is struck by a striker that is activated when the movable weight component (22) reaches or passes by a certain defined point and so generates a resistance that is known to be beneficial for the exercising of the user. In this way, the user can receive basic feedback for each swing by listening for the sound of the bell that indicates that their swing met certain criteria. In other cases, the indicator may comprise a light that is activated when the movable weight component (22) reaches or passes by a certain defined point.

In some embodiments, the swing exercising apparatus (10) may comprise a safety mechanism to preclude the movable weight component (22) from flying off during the swing movement in case, for example, the elongated member (16) and/or the capping element (44) fails. The safety mechanism provides a fail-safe feature to prevent the movable weight component (22) from separating from the swing exercising apparatus (10) in such situations. For example, in some embodiments, the safety mechanism may comprise a tethered safety element such as a wire, a string, a cord or the like located in the interior space of the elongated member (16) and secured at the proximal end (18) of the elongated member (16). The tethered safety element may comprise a blocking element at its outer distal end, protruding from the elongated member (16). The blocking element may have a width larger than the diameter of the longitudinally extending opening in the movable weight component (22), thereby preventing the movable weight component (22) from falling off the tethered safety element. The tethered safety element may be installed on the swing exercising apparatus (10) in various other ways and the safety mechanism may be configured in various other ways in other embodiments.

In some embodiments, the swing exercising apparatus (10) may comprise a damper positioned on the elongated member (16) between the stationary element (34) and the proximal end of the movable weight component (22). The purpose of the damper is to dampen the shock when the movable weight component (22) returns to its rest position. For example, the damper may be made of a material (e.g., rubber) which has a vibration suppressing effect.

Although various embodiments and examples have been presented, this was for the purpose of describing, but not limiting, the invention. Various modifications and enhancements will become apparent to those of ordinary skill in the art and are within the scope of the invention, which is defined by the appended claims.

The invention claimed is:

1. A swing exercising apparatus for use by a user, the swing exercising apparatus comprising:

an elongated member having a proximal end and a distal end;

a movable weight component for moving along the elongated member between a first position and a second position when the user swings the swing exercising apparatus; and a biasing mechanism comprising at least one elastic element for exerting a force when the movable weight component is located along the elongated member away from the first position, the force biasing the movable weight component towards the first position as the movable weight component moves from the first position to the second position, the force moving the movable weight component from the second position to the first position upon the movable weight component reaching the second position, a given elastic element of the at least one elastic element of the biasing mechanism being detachable by the user to adjust the force to allow the force to be different when the given elastic element of the biasing mechanism is detached.

2. The swing exercising apparatus claimed in claim 1, wherein the force is a first force, the swing exercising apparatus comprising a deceleration mechanism comprising at least one elastic element for starting to exert a second force when the movable weight component approaches the second position, the second force decelerating the movable weight component as the movable weight component moves towards the second position.

3. The swing exercising apparatus claimed in claim 2, wherein the at least one elastic element of the deceleration mechanism comprises a spring.

4. The swing exercising apparatus claimed in claim 2, wherein the first force is exerted when the movable weight component causes the at least one elastic element of the biasing mechanism to be stretched and the second force is exerted when the movable weight component causes the at least one elastic element of the deceleration mechanism to be compressed.

5. The swing exercising apparatus claimed in claim 2, wherein the deceleration mechanism is configured such that the movable weight component engages the at least one elastic element of the deceleration mechanism when the movable weight component is located closer to the second position than to the first position.

6. The swing exercising apparatus claimed in claim 2, wherein a position along the elongated member at which the deceleration mechanism starts to exert the second force is adjustable.

7. The swing exercising apparatus claimed in claim 2, wherein the second force moves the movable weight component from the second position towards the first position upon the movable weight component reaching the second position.

8. The swing exercising apparatus claimed in claim 2, wherein the first force and the second force act in a common direction.

9. The swing exercising apparatus claimed in claim 1, comprising a handle for grasping by the user, the handle having a longitudinal axis, the elongated member being configured such that, when the movable weight component moves along the elongated member towards the second position, the movable weight component follows a path diverging from the longitudinal axis of the handle.

10. The swing exercising apparatus claimed in claim 9, wherein the elongated member comprises a first section generally parallel to the longitudinal axis of the handle and a second section forming the path diverging from the longitudinal axis of the handle.

11. The swing exercising apparatus claimed in claim 9, wherein the path diverges from the longitudinal axis of the handle by an angle between about 5 to about 60 degrees.

12. The swing exercising apparatus claimed in claim 1, comprising: a handle for grasping by the user; and an arm attachment for attaching an arm of the user to the swing exercising apparatus, the arm attachment comprising an arm engaging portion for engaging the arm of the user in a region remote from a wrist of the user to reduce stress on the wrist of the user when the user swings the swing exercising apparatus.

13. The swing exercising apparatus claimed in claim 12, wherein the region is adjacent to an elbow of the arm of the user.

14. The swing exercising apparatus claimed in claim 12, wherein the arm engaging portion comprises a strap for strapping the arm of the user in the region remote from the wrist of the user.

15. The swing exercising apparatus claimed in claim 1, comprising a safety mechanism preventing the movable weight component from separating from the swing exercising apparatus during use.

16. The swing exercising apparatus claimed in claim 15, wherein the safety mechanism is a tethered safety mechanism.

17. The swing exercising apparatus claimed in claim 1, wherein the given elastic element of the biasing mechanism is replaceable with a different elastic element by the user to adjust the force.

18. The swing exercising apparatus claimed in claim 17, wherein a size of the different elastic element differs from a size of the given elastic element of the biasing mechanism.

19. The swing exercising apparatus claimed in claim 17, wherein a material of the different elastic element differs from a material of the given elastic element of the biasing mechanism.

20. The swing exercising apparatus claimed in claim 17, wherein (i) a size of the different elastic element differs from a size of the given elastic element of the biasing mechanism and (ii) a material of the different elastic element differs from a material of the given elastic element of the biasing mechanism.

21. The swing exercising apparatus claimed in claim 1, wherein the biasing mechanism comprises an attachment portion, the at least one elastic element of the biasing mechanism being attached to the attachment portion, the attachment portion allowing the user to detach the given elastic element of the biasing mechanism to adjust the force, the given elastic element of the biasing mechanism being attached to a fixed attachment point and a movable attachment point of the attachment portion, the fixed attachment point remaining stationary relative to the elongated member when the movable weight component moves along the elongated member, the movable attachment point moving along the elongated member when the movable weight component moves along the elongated member.

22. The swing exercising apparatus claimed in claim 21, comprising a position adjustor to adjust a position of the fixed attachment point relative to the elongated member.

23. The swing exercising apparatus claimed in claim 21, wherein the attachment portion comprises an aperture receiving an end portion of the given elastic element of the biasing mechanism and allowing the user to remove the given elastic element of the biasing mechanism from the aperture.

24. The swing exercising apparatus claimed in claim 1, wherein the at least one elastic element of the biasing mechanism is a plurality of elastic elements.

25. The swing exercising apparatus claimed in claim 24, wherein the given elastic element of the biasing mechanism is a first given elastic element of the biasing mechanism, a second given elastic element of the elastic elements of the biasing mechanism being detachable by the user to adjust the force to allow the force to be different when the second given elastic element of the biasing mechanism is detached.

26. The swing exercising apparatus claimed in claim 25, wherein the different elastic element is a first different elastic element, the second given elastic element of the biasing mechanism being replaceable with a second different elastic element by the user to adjust the force.

27. The swing exercising apparatus claimed in claim 24, wherein the elastic elements of the biasing mechanism surround the elongated member.

28. The swing exercising apparatus claimed in claim 1, wherein the elongated member has an outer side, the movable weight component being mounted on the outer side of the elongated member.

29. The swing exercising apparatus claimed in claim 28, wherein the biasing mechanism is located on the outer side of the elongated member.

30. The swing exercising apparatus claimed in claim 1, wherein the at least one elastic element of the biasing mechanism comprises an elastomeric element.

31. The swing exercising apparatus claimed in claim 30, wherein the elastomeric element is a latex element.

32. The swing exercising apparatus claimed in claim 1, wherein the given elastic element of the biasing mechanism is removable by the user to adjust the force.

33. The swing exercising apparatus claimed in claim 1, wherein each of the at least one elastic element of the biasing mechanism is generally parallel to and offset from a longitudinal axis of the elongated member.

34. The swing exercising apparatus claimed in claim 1, wherein the at least one elastic element of the biasing mechanism comprises a spring.

35. The swing exercising apparatus claimed in claim 1, wherein the movable weight component comprises a weight loading section allowing at least one weight element to be loaded or removed from the movable weight component to adjust a total weight of the movable weight component.

36. The swing exercising apparatus claimed in claim 1, comprising a position adjustor to adjust the first position of the movable weight component along the elongated member.

37. The swing exercising apparatus claimed in claim 1, comprising: a handle for grasping by the user; and an arm attachment for attaching an arm of the user to the swing exercising apparatus, the arm attachment comprising an arm engaging portion for engaging the arm of the user in a region remote from a wrist of the user such that, when the user swings the swing exercising apparatus, the arm attachment inhibits bending of the wrist of the user.

38. The swing exercising apparatus claimed in claim 1, comprising a handle for grasping by the user, the handle being configured as a golf club handle, a hockey stick handle, a cricket bat handle, a baseball bat handle, or a racquet handle.

39. The swing exercising apparatus claimed in claim 1, comprising a handle for grasping by the user, the handle being detachable from the swing exercising apparatus to allow the user to replace the handle with a different handle.

40. A swing exercising apparatus for use by a user, the swing exercising apparatus comprising:

an elongated member having a proximal end and a distal end;

a movable weight component for moving along the elongated member between a first position and a second position when the user swings the swing exercising apparatus;

a biasing mechanism comprising at least one elastic element for exerting a first force when the movable weight component is located along the elongated member away from the first position, the first force biasing the movable weight component towards the first position as the movable weight component moves from the first position to the second position, the first force moving the movable weight component from the second position to the first position upon the movable weight component reaching the second position; and a deceleration mechanism comprising at least one elastic element for starting to exert a second force when the movable weight component approaches the second position, the second force decelerating the movable weight component as the movable weight component moves towards the second position.

41. The swing exercising apparatus claimed in claim 40, wherein the second force moves the movable weight component from the second position back towards the first position upon the movable weight component reaching the second position.

42. The swing exercising apparatus claimed in claim 41, wherein the deceleration mechanism is configured for stopping to exert the second force before the movable weight component reaches the first position.

43. The swing exercising apparatus claimed in claim 40, wherein the biasing mechanism is adjustable to allow the user to adjust the first force.

44. The swing exercising apparatus claimed in claim 43, wherein a given elastic element of the at least one elastic element of the biasing mechanism is detachable by the user to adjust the force to allow the force to be different when the given elastic element of the biasing mechanism is detached.

45. The swing exercising apparatus claimed in claim 44, wherein the given elastic element of the biasing mechanism is removable by the user to adjust the force.

46. The swing exercising apparatus claimed in claim 44, wherein the given elastic element of the biasing mechanism is replaceable with a different elastic element by the user to adjust the force.

47. The swing exercising apparatus claimed in claim 46, wherein a size of the different elastic element differs from a size of the given elastic element of the biasing mechanism.

48. The swing exercising apparatus claimed in claim 46, wherein a material of the different elastic element differs from a material of the given elastic element of the biasing mechanism.

49. The swing exercising apparatus claimed in claim 46, wherein (i) a size of the different elastic element differs from a size of the given elastic element of the biasing mechanism and (ii) a material of the different elastic element differs from a material of the given elastic element of the biasing mechanism.

50. The swing exercising apparatus claimed in claim 40, wherein the deceleration mechanism is configured such that the movable weight component engages the at least one elastic element of the deceleration mechanism when the movable weight component is located closer to the second position than to the first position.

51. The swing exercising apparatus claimed in claim 40, wherein the first force and the second force act in a common direction.

52. The swing exercising apparatus claimed in claim 40, comprising: a handle for grasping by the user; and an arm attachment for attaching an arm of the user to the swing exercising apparatus, the arm attachment comprising an arm engaging portion for engaging the arm of the user in a region remote from a wrist of the user to reduce stress on the wrist of the user when the user swings the swing exercising apparatus.

53. The swing exercising apparatus claimed in claim 40, comprising: a handle for grasping by the user; and an arm attachment for attaching an arm of the user to the swing exercising apparatus, the arm attachment comprising an arm engaging portion for engaging the arm of the user in a region remote from a wrist of the user such that, when the user swings the swing exercising apparatus, the arm attachment inhibits bending of the wrist of the user.

54. The swing exercising apparatus claimed in claim 40, wherein each of the at least one elastic element of the biasing mechanism is generally parallel to and offset from a longitudinal axis of the elongated member.

55. A swing exercising apparatus for use by a user, the swing exercising apparatus comprising:

an elongated member having a proximal end and a distal end;

a movable weight component for moving along the elongated member between a first position and a second position when the user swings the swing exercising apparatus;

a biasing mechanism for exerting a first force when the movable weight component is located along the elongated member away from the first position, the first force biasing the movable weight component towards the first position as the movable weight component moves from the first position to the second position, the first force moving the movable weight component from the second position to the first position upon the movable weight component reaching the second position; and a resistance-increasing mechanism for starting to exert a second force when the movable weight component is located closer to the second position than to the first position, the second force decelerating the movable weight component as the movable weight component moves towards the second position, the second force increasing a resistance felt by the user.

56. A swing exercising apparatus for use by a user, the swing exercising apparatus comprising:

an elongated member having a proximal end and a distal end;

a movable weight component for moving along the elongated member between a first position and a second position when the user swings the swing exercising apparatus;

a biasing mechanism comprising at least one elastic element for exerting a force when the movable weight component is located along the elongated member away from the first position, the force biasing the movable weight component towards the first position as the movable weight component moves from the first position to the second position, the force moving the movable weight component from the second position to the first position upon the movable weight component reaching the second position; and an arm attachment for attaching an arm of the user to the swing exercising apparatus, the arm attachment comprising an arm engaging portion for engaging the arm of the user in a region remote from a wrist of the user to reduce stress on the wrist of the user when the user swings the swing exercising apparatus.

* * * * *